United States Patent [19]

Yogo et al.

[11] Patent Number: 4,653,581

[45] Date of Patent: Mar. 31, 1987

[54] PLATE TYPE HEAT EXCHANGER

[75] Inventors: Takeji Yogo, Sakado; Akitsuna Nakagaki, Kawagoe; Akio Miyazawa, Kamifukuoka, all of Japan

[73] Assignee: Kabushiki Kaisha Tsuchiya Seisakusho, Tokyo, Japan

[21] Appl. No.: 749,101

[22] Filed: Jun. 26, 1985

[30] Foreign Application Priority Data

Jun. 28, 1984 [JP] Japan ..... 59-97158[U]

[51] Int. Cl.[4] ..... F28F 3/08

[52] U.S. Cl. ..... 165/166; 165/167

[58] Field of Search ..... 165/166, 167

[56] References Cited

U.S. PATENT DOCUMENTS

| | | | |
|---|---|---|---|
| 2,865,613 | 12/1958 | Egenwall et al. | 257/245 |
| 3,114,686 | 12/1963 | Edwards et al. | 165/167 X |
| 3,360,038 | 12/1967 | Stampes | 165/166 |
| 4,014,385 | 3/1977 | Wright | 165/167 |
| 4,340,114 | 7/1982 | Levy | 165/166 X |

FOREIGN PATENT DOCUMENTS

| | | | |
|---|---|---|---|
| 532166 | 10/1954 | Belgium | 165/167 |
| 58-148480 | 10/1983 | Japan . | |

*Primary Examiner*—William R. Cline
*Assistant Examiner*—Richard R. Cole
*Attorney, Agent, or Firm*—Schwartz, Jeffery, Schwaab, Mack, Blumenthal & Evans

[57] ABSTRACT

A plate type heat exchanger consists of a plurality of heat transmission plates which are piled up and secured to each other. Side wall members are interposed between the adjacent heat transmission plates, so that multiple stages of spaces are formed in the heat exchanger. Additionally, separator wall members are interposed between the adjacent heat transmission plates in such a manner that two fluid paths are defined in alternate stages of the spaces. The side wall members and the separator members are formed of rod material, thereby rendering the heat exchanger light in weight while lowering the production cost of the heat exchanger.

12 Claims, 8 Drawing Figures

PLATE TYPE HEAT EXCHANGER

BACKGROUND OF THE INVENTION

1. Field of the Invention

The present invention relates generally to a heat exchanger of the type wherein a plurality of packets of sheet metal are piled up, and more particularly to the heat exchanger of a so-called housing-less type wherein alternate fluid flow paths for fluids are formed in the heat exchanger without using a housing.

2. Description of the Prior Art

In connection with plate type heat exchangers, it has been already proposed that a plurality of packets of sheet metal are piled up and secured to each other to form a so-called housing-less plate type heat exchanger in which a space is formed between the adjacent packets by means of plate type thick distance pieces each of which is interposed between the adjacent packets, thereby forming multiple stages of spaces in which two fluid flow paths for two fluids are formed on alternate stages of spaces. Heat exchanging between the two fluids is accomplished through a packet serving as an interface between the adjacent two fluid paths.

However, drawbacks have been encountered in the thus arranged conventional heat exchanger, in which the above-mentioned plate type thick distance pieces are considerably heavy in weight and therefore contribute to increasing the weight of the heat exchanger, thereby requiring large-sized installation or support means for the heat exchanger. Furthermore, since the distance pieces are usually produced by machining a blank plate material, a higher cost for the production process is required. Moreover, a large amount of heat is required for brazing because the thick distance pieces require a larger amount of brazing metal and are larger in heat capacity, thus increasing the cost for brazing.

SUMMARY OF THE INVENTION

According to the present invention, the plate type heat exchanger consists of a plurality of sheet metal packets or heat transmission plates which are piled up and fixed to each other. Side wall members are interposed between the adjacent heat transmission plates, so that multiple stages of spaces are formed in the heat exchanger. Additionally, separator wall members are interposed between the adjacent heat transmission plates in such a manner that two kinds of fluid flow paths for two fluids are defined in alternate stages of spaces. The side wall members and the separator wall members are fixed to the heat transmission plates under brazing and formed of rod material.

By virtue of the side wall members and the separator wall members being formed of rod material, the heat exchanger can be prevented from becoming of heavy weight, thereby rendering small-sized installation or support means therefor. The side wall members and the separator wall members are produced only by bending straight rod material and therefore never require machining process thus to facilitate the production process. Less brazing metal and less heat are necessary for the brazing of the heat exchanger, thereby lowering the production cost of the heat exchanger as compared with the conventional heat exchanger in which the plate type thick distance pieces are used in the place of the side wall members and the separator wall members.

BRIEF DESCRIPTION OF THE DRAWINGS

The features and advantages of the plate type heat exchanger of the present invention will be more clearly appreciated from the following description taken in conjunction with the accompanying drawings in which like reference numerals designate like parts and elements, in which.

DETAILED DESCRIPTION OF THE INVENTION

Figure 1:
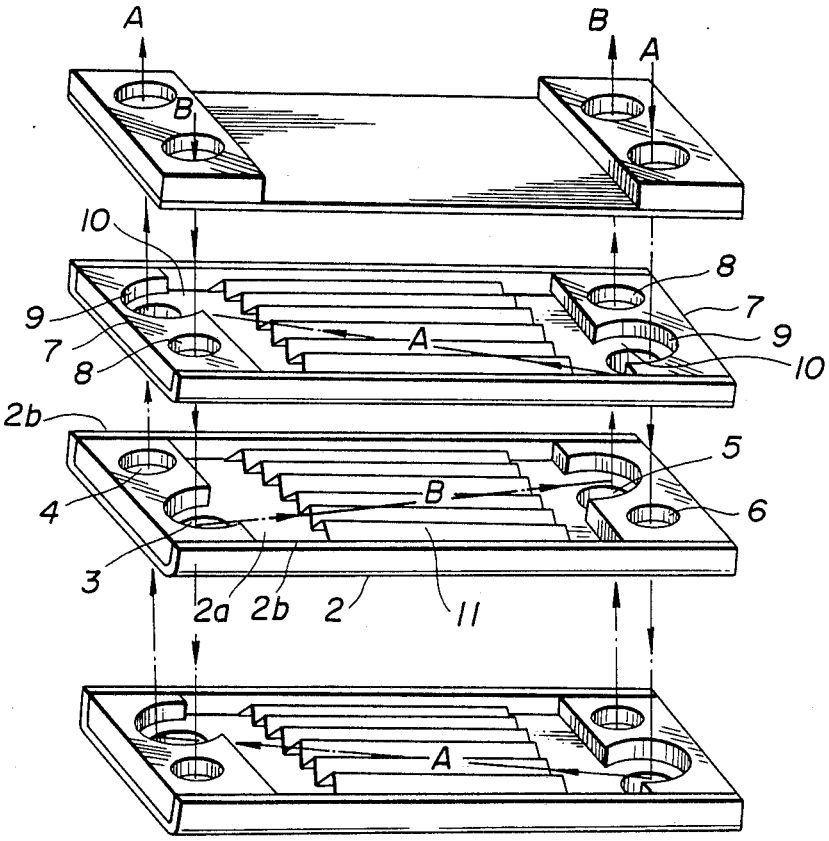
FIG. 1 (Prior Art)
FIG. 1 is an exploded perspective view of a conventional plate type heat exchanger.

To facilitate understanding the present invention, a brief reference will be made to a conventional plate type heat exchanger, depicted in FIG. 1. Referring to FIG. 1, the conventional heat exchanger consists of a plurality of heat transmission plates 2 piled up and secured to each other, for example, by means of brazing. Each plate 2 includes a bottom plate section 2*a* which is integrally provided at the longer sides with two opposite raised sections 2*b*. The bottom plate section 2*a* is formed with a pair of openings 3, 4 located in the vicinity of one shorter side thereof, and a pair of openings 5, 6 located in the vicinity of the other shorter side thereof.

Additionally, two distance pieces 7 of the thick plate type are interposed between the adjacent plates 2 and respectively located oppositely in the vicinities of the shorter sides of the plate section 2*a*. Each distance piece 7 is formed with two through-holes 8, 9 which are respectively communicated with the openings 3, 4 or with the openings 5, 6. As shown, one of the two through-holes 8, 9 of the distance piece 7 is formed with a cutout portion 10 through which the through-hole 9 merges in a space defined between the adjacent two plates 2, 2. Such a cutout portion 10 is formed with the through-hole 8 or with the through-hole 9 of the distance pieces on alternate stages for the adjacent two plates 2. As a result, a fluid flow path A, B is formed in the space between the adjacent two plates 2, 2 in such a manner as to connect the through-holes 8, 8 (with the cutout portion 10) or to connect the through-holes 9, 9 (with the cutout portion 10) of the two distance piece 7, 7 with each other. Accordingly, two independent fluid flow paths A, B for two fluids are formed on the opposite sides of the plate section 2*a* of each plate 2. Thus, the same fluid flow paths for the same fluids are formed on alternate spaces between the adjacent plates 2, 2. The reference numeral 11 designates a corrugated plate or fin fixedly disposed in the space between the adjacent plates 2, 2.

However, since such a conventional plate type heat exchanger is provided with the plate type thick distance pieces 7, the weight of the heat exchanger becomes large and therefore a higher strength is required for installing or supporting means for the heat exchanger, thereby unavoidably rendering the installing means large-sized. In this regard, there are many cases where the weight of the distance pieces become 50% of the whole weight of the heat exchanger. In addition, the distance pieces are usually produced by machining such as cutting, which will increase the cost required for the material machining process. Furthermore, since the required amount of brazing metal for the heat exchanger is larger and the heat capacity of the heat exchanger is larger due to the plate type thick distance pieces 7, a larger amount of heat is necessary for brazing, thereby increasing the cost for brazing. Moreover, the cutout portion of the through-hole of the distance piece may increase the fluid flow resistance in the heat exchanger, depending upon the shape thereof.

In view of the above description of the conventional plate type heat exchanger, reference is now made to FIGS. 2, 3, 4, and 5 wherein an embodiment of a plate type heat exchanger of the present invention is illustrated by the reference numeral 10. The heat exchanger 10 comprises a plurality of heat transmission plates 12, each of which includes a flat and rectangular plate section or bottom wall section 12*a* which has two opposite longer sides $S_1$ and two opposite shorter sides $S_2$. The plate section 12*a* is provided at its each longer sides $S_1$ with a vertical wall section 12*b*. The vertical wall section 12*b* is usually formed by bending a longer side of a blank plate material. The two vertical wall sections 12*b* are generally vertical relative to the plate section 12*a*, but slightly bent outwardly so that an angle slightly larger than right angles is formed between the vertical wall section 12*b* and the plate section 12*a*. Each plate section 12*a* is formed with two openings 13, 14 located in the vicinity of one of the shorter sides $S_2$, and two openings 15, 16 located in the vicinity of the other shorter side $S_2$. As shown, the openings 13, 15 are positioned on the opposite side of the openings 14, 16 with respect to the center axis X of the plate section 12*a*.

Figure 4:
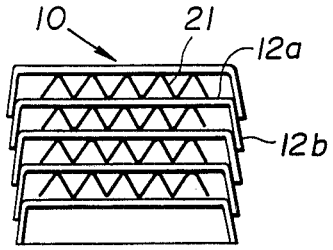
FIG. 4 is an enlarged schematic vertical sectional view of the heat exchanger of FIG. 3.
Figure 5:
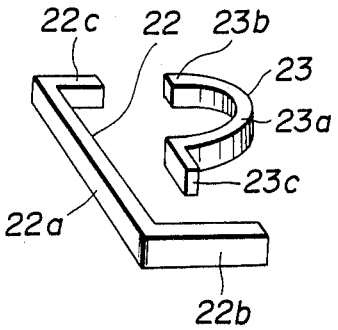
FIG. 5 is an exploded perspective view of a set of a side wall member and a separator wall member used in the embodiment of the heat exchanger of FIG. 2.

The thus arranged heat transmission plates 12 are piled up in such a manner that the upper or base parts of the vertical wall sections 12*b* of one heat transmission plate 12 fits inside the tip or lower parts of the vertical wall sections 12*b* of another heat transmission plate 12 located on the above-mentioned one heat transmission plate 12 as shown in FIG. 4. The corresponding openings (for example, the openings 13, 13, 13 . . . ) of the piled up heat transmission plates 12 are vertically aligned with each other. In this embodiment, the vertical wall sections 12*b* project downwardly from the plate section 12*a* and extend along the longer side $S_2$ of the plate section 12*a*. It will be understood that the heat transmission plates 12 may be piled up in such a manner that the vertical wall sections 12*b* project upwardly from the plate section 12*a* as shown in FIG. 1. The lower-most heat transmission plate 12 is fixedly provided with two installation flanges 25, 25 which are respectively located to securely close the plate section openings 13, 14 and the plate section openings, 15, 16. The upper-most heat transmission plate 12 is fixedly provided with connector flanges 26, 26 each of which is formed with a pair of openings 27, 28. The openings 27, 28 of one flange 26 are respectively communicated with the openings 13, 14 of the upper-most heat transmission plate 12 while the openings 27, 28 of the other flange 26 are respectively communicated with the openings 15, 16. It will be appreciated that the connector flanges 26, 26 may be installed to the lower-most heat transmission plate 12 while the installation flanges 25, 25 may be installed to the upper-most heat transmission plate 12.

Two side wall members 22, 22 are fixedly interposed between the adjacent heat transmission plates 12, 12, and located in the vicinity of the opposite shorter sides $S_2$, respectively. In this embodiment, each side wall member 22 includes first, second, and third straight sections 22*a*, 22*b*, 22*c*. The first straight section 22*a* straight extends along the shorter side $S_2$ of the plate section 12*a*. The second and third straight sections 22*b*, 22*c* straight extend along the opposite longer sides $S_1$, $S_1$, and are integral with the first straight section 22*a* at the opposite ends in such a manner as to be perpendicular to the first straight section 22*a*. The length of the second straight section 22*b* is larger than that of the third straight section 22*c*. It is to be noted that each side wall member 22 is formed of a rod material having a rectangular cross-section, and produced by bending at right angles the opposite end sections (corresponding to the second and third straight sections 22*b*, 22*c*) of the rod material in the straight shape. The thus formed second and third sections 22*b*, 22*c* are respectively brought into contact with the inner surface of the vertical wall sections 12*b*, 12*b* of the heat transmission plate 12. The side wall member 22 has a height $H_1$ slightly smaller than that $H_2$ of the vertical wall sections 12*b* of the heat transmission plate 12. As shown, the two side wall sections 22 on one plate section 12*a* are so arranged that the second section 22*b* of one side wall member 22 faces the third section 22*c* of the other side wall member 22. Accordingly, a rectangular space is formed between the adjacent two transmission plates 12, 12, and between the opposite two side wall members 22, 22.

Two separator wall members 23, 23 are fixedly interposed between the two adjacent heat transmission plates 12, 12 at their plate section 12*a*. Each separator wall member 22 is located in the vicinity of the shorter side $S_2$ of the plate section 12*a* of the heat transmission plate 12. The two separator wall members 23, 23 are such arranged that one of them in the lower-most space is so positioned as to generally surround the opening 14 in cooperation with the side wall member 22 and the other in the same space is so positioned as to generally surround the openings 15 in cooperation with the side wall member 22, while one of them in the next upper space is so positioned as to generally surround the openings 13 and the other in the same space is so positioned as to generally surround the openings 16. Each separator wall member 13 defines a vertical fluid flow passage (no numeral) connecting the corresponding openings (for example, the openings 14, 14) of the adjacent heat transmission plates 12. Each vertical fluid flow passage is separate and independent from a horizontal fluid passage (no numeral) for connecting, for example, the opening 13 and the opening 16. The vertical and horizontal fluid passages form part of first and second fluid flow path A, B.

Each separator wall member 23 is generally C-shaped and includes first, second and third sections, 23*a*, 23*b*, 23*c* which are integral with each other. The first section 23*a* is so curved as to surround the openings 13, 14, 15, 16. The second and third sections 23*b*, 23*c* are connected to the opposite ends of the first section 23*a*, in which the second section 23*b* straight extends along the longer side $S_1$ of the plate section 12*a* and faces the third section 22*c* of the side wall member 22 while the third section 23*c* straight extends along the shorter side $S_2$ and contacts the first section 22*a* of the side wall member 22. As seen from FIG. 2, the separator wall members are respectively located in the same positions in alternate spaces each of which is formed between the adjacent two heat transmission plates 12, 12, so that the same vertical and horizontal fluid passages are formed in alternate spaces. It is to be noted that each separator wall member 23 is formed of a rod material having a rectangular cross-section and has the same height as the side wall member 22. The separator wall member 23 is produced by bending the straight shape rod material into a desired shape thereof. Additionally, a corrugated plate or fin 21 is rigidly interposed between the adjacent two heat transmission plates 12 at their plate section 12*a*. The corrugated plate 21 is formed with a plurality of alternate ridges and troughs 21*a*, 21*b*, in which the each ridge 21*a* contacts the plate section 12*a* of the upper heat transmission plate 12 while each trough 21*b* contacts the plate section 12*a* of the lower heat transmission plate 12. It is to be noted that the side wall members 22, the separator wall members 23, and the corrugated plates 21 are made of metal and fixedly connected to the heat transmission plates 12 by means of brazing in which a brazing metal is supplied to the positions at which they contact with each other.

Figure 2:
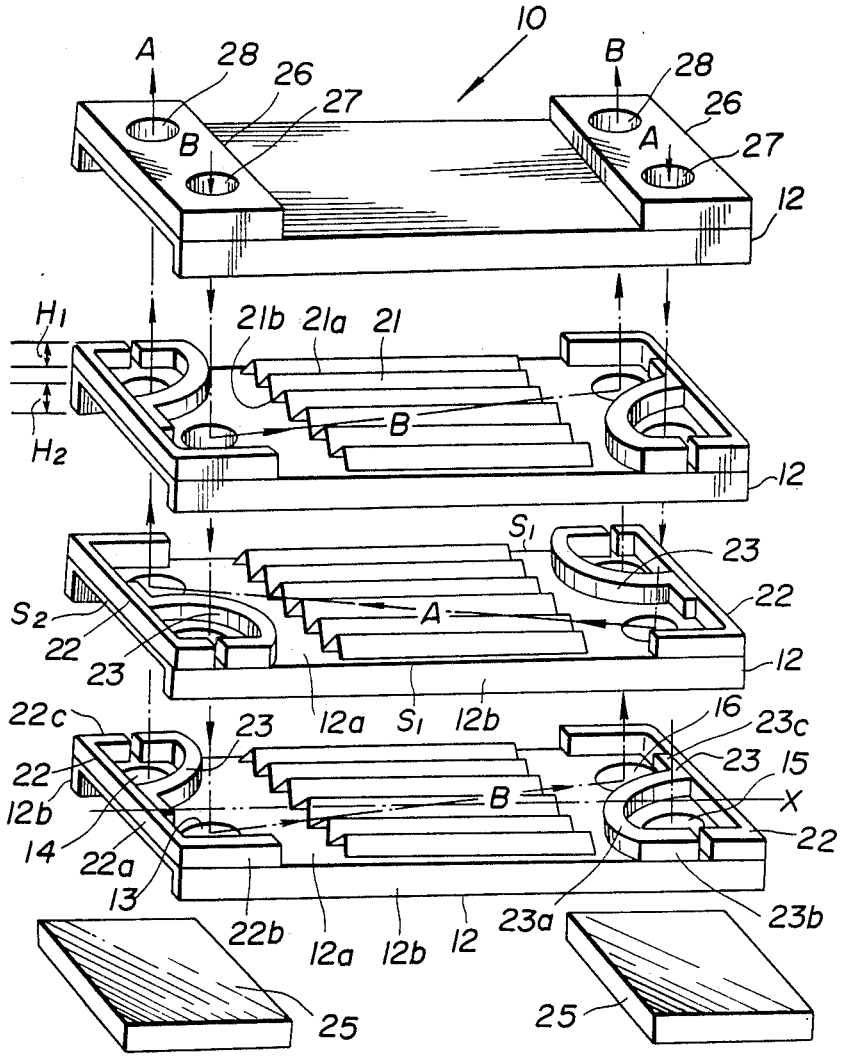
FIG. 2 is an exploded perspective view of an embodiment of a plate type heat exchanger of the present invention.

Thus, the diagonally located and parallely extending two vertical fluid passages are communicated with each other through the horizontal fluid passages formed in alternate spaces each being defined between the adjacent heat transmission plates 12, 12, thereby constituting the first fluid flow path A for a first fluid and the second fluid flow path B for a second fluid as illustrated in FIG. 2.

With the thus configurated plate type heat exchanger 10, the first fluid is introduced from the opening 27 of one connector flage 26 and flows through the inside of the heat exchanger 10 along the first fluid flow path A and discharged from the opening 28 of the other connector flange 26. In contrast with this, the second fluid is introduced from the opening 27 of the above-mentioned other connector flange 26 and flows through the inside of the heat exchanger 10 along the second fluid flow path B and discharged from the opening 28 of the above-mentioned one connector flange 26. During flow of the fluids through the space between the adjacent heat transmission plates 12, 12, each fluid flows along the axes of the ridges 21*a* and the troughs 21*b* of the corrugated plate 21. Thus, the first and second fluids flow in the opposite directions in the adjacent spaces on the opposite sides of the plate section 12*a* of the heat transmission plate 12, so that heat exchanging between the first and second fluids takes place through the plate section 12*a*.

Figure 6:
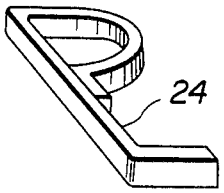
FIG. 6 is a perspective view of a one-piece wall member as a modified form of a set of the side wall member and the separator wall member.

FIG. 6 shows a modified form of a part of the plate type heat exchanger of the present invention, in which the side wall member (22) and the separator wall member (23) is integrally connected with each other to form one-piece wall member 24. The one-piece wall member 24 is formed by bending a rod material into the shape of FIG. 6 wherein the tip end of the second section 23*b* of the separator wall member 23 is integrally connected with the tip end of the third section 22*c* of the side wall member 22. It will be understood that the one-piece wall member 24 may be used in place of a set of the side wall member 22 and the separator wall member 23.

Figure 7:
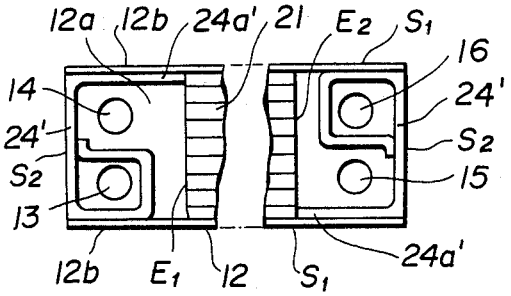
FIG. 7 is a plan view of a stage of a modified example of the heat exchanger of the present invention.

FIG. 7 shows a modified example of the plate type heat exchanger of the present invention. In this example, a one-piece wall member 24' formed of a rod material has a straight end section 24*a'* which extends along the longer side $S_1$ of the heat transmission plate section 12*a*. The end section 24*a'* extends to and contacts with a side edge $E_1$, $E_2$ of the corrugated plate 21, so that the corrugated plate is put between the opposite end sections 24*a'*, 24*a'* of the oppositely disposed one-piece wall members 24', 24', thereby fixedly maintaining the corrugated plate 21 in position. Accordingly, the corrugated plate 21 can be prevented from shifting or movement during assembly and brazing processes, thereby avoiding an increase in fluid flow resistance and a lowering in heat exchanging efficiency both due to the shifting of the corrugated plate 21 while facilitating the assembly of the heat exchanger.

Figure 3:
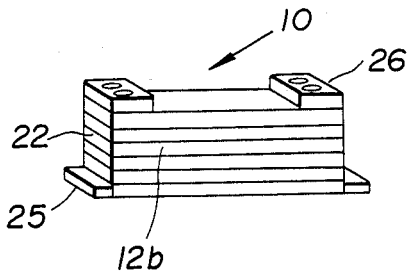
FIG. 3 is a perspective view of the heat exchanger of FIG. 2 upon being assembled.
Figure 8:
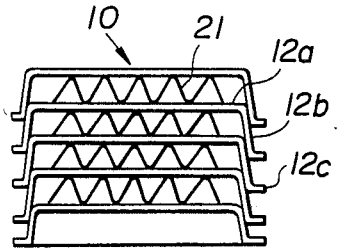
FIG. 8 is a schematic vertical sectional view of another modified example of the heat exchanger of the present invention.

FIG. 8 shows another modified example of the plate type heat exchanger of the present invention, which is similar to the embodiment of FIGS. 2 to 4 with the exception that the vertical wall section 12*b* of the heat transmission plate 12 is provided with a flange section 12*c* for reinforcement purpose. The flange section 12*c* is integral with the vertical wall section 12*b* and projects generally horizontally from tip edge of the vertical wall section 12*b*. The flange section 12*c* extends along the longer side $S_1$ of the plate section 12*a* of the heat transmission plate 12.

As is appreciated from the above, with the above-discussed housing-less and plate type heat exchanger in which the side wall members and the separator wall are formed of rod material, the weight of the heat exchanger can largely decreased, so that installation or support means such as flanges and bolts are sufficient to be simple and small-sized. Furthermore, the side wall members and the separator wall members do not require machining process such as cutting, so that only chopping off and bending a rod material are required, thereby facilitating production of the heat exchanger. Moreover, the side wall members and the separator wall members have smaller cross-sectional area and smaller contacting area in contact with the heat transmission plates, so that less brazing metal and less heating are required thereby to reduce the production cost. Additionally, by suitably selecting the curved shape of the separator wall member, the flow resistance of the fluid flowing toward the corrugated plate (fin) can be suppressed to a considerably lower level.

What is claimed is:

1. A plate type heat exchanger for first and second fluids, comprising:

a first heat transmission plate made of a sheet metal, including a first rectangular and flat plate section having first and second longer opposite sides, and first and second shorter opposite sides, said first plate section being formed with first and second openings located in the vicinity of said first shorter side, and third and fourth openings located in the vicinity of said second shorter side, and first and second vertical wall sections integrally connected to said first plate section respectively at said first and second longer sides, and being generally vertical relative to said first plate section, a second heat transmission plate made of a sheet metal, disposed in spaced parallel relation to said first heat transmission plate and located above said first heat transmission plate, said second heat transmission plate including a second rectangular and flat plate section having third and fourth longer opposite sides, and third and fourth shorter opposite sides, said second plate section being formed with fifth and sixth openings located in the vicinity of said third shorter side, and seventh and eighth openings located in the vicinity of said fourth shorter side, and third and fourth vertical wall sections integrally connected to said second plate section respectively at said third and fourth longer sides, and being generally vertical relative to said second plate section;

first and second side wall members made of metal, interposed between said first and second plate sections to define a space, said first side wall member being located in the vicinity of said first and third shorter sides, said second side wall member being located in the vicinity of said second and fourth shorter sides, each of said first and second side wall members being formed of a rod material;

first and second separator wall members made of metal, interposed between said first and second plate sections to divide said space into a first fluid flow passage through which a first fluid flows from said first opening to said fourth opening, a second fluid flow passage through which the second fluid flows from said second opening to said sixth opening, and a third fluid passage through which the second fluid flows from said third opening to said seventh opening, said second and third flow passages being communicated with each other, each of said first and second separator wall members being formed of a rod material;

a corrugated plate made of metal, disposed in said first flow passage and between said first and second plate sections; and means for fixedly connecting said side wall members and said separator wall members, and said corrugated member to said first and second heat transmission plates under brazing;

wherein said side wall member and said separator wall member are the same in height and smaller in height than said vertical wall sections of said heat transmission plates; wherein each of said first heat transmission plate vertical wall sections is slightly inclined relative to said plate section so that an angle slightly larger than right angles is formed between the vertical wall section and the plate section; wherein each of said second heat transmission plate vertical wall sections is slightly inclined relative to said plate section so that an angle slightly larger than right angles is formed between the vertical wall section and the plate section; wherein each of said first and second vertical wall sections extends downwardly from said first plate section; wherein each of said third and fourth vertical wall sections extends from said second plate section in the same direction as said first and second vertical wall section, said third and fourth vertical wall sections being contactable with said first and second vertical wall sections; wherein each of said first and second side wall members includes a first straight section located along the. shorter side, a second straight section integral with said first straight section and located along the longer side, and a third straight section integral with said first straight section and located along the longer side; wherein said first separator wall member is so located as to surround, in cooperation with said first side wall member, said second and sixth openings, and said second separator wall member is so located as to surround, in cooperation with said second side wall member, said third and seventh openings; wherein said first and third openings are positioned on the opposite side of said second and fourth openings with respect to a longitudinal center axis of said first heat transmission plate; wherein said fifth and seventh openings are positioned on the opposite side of said sixth and eighth openings with respect to a longitudinal center axis of said second heat transmission plate; wherein said first separator wall member includes a first section located near the periphery of said second opening, a second straight section integral with said first section and located along the second longer side of said first plate section, and a third straight section integral with said first section and located along the first shorter side, said third section contacting said first side wall member first section; wherein said second separator wall member includes a first section located near the periphery of said third opening, a second straight section integral with said first section and located along said first longer side of said first plate section, and a third straight section integral with said first section and located along the second shorter side, said third section contacting said second side wall member first section.

2. A plate type heat exchanger as claimed in claim 1, wherein said rod material of said side wall members and said separator wall members has a rectangular cross-section.

3. A plate type heat exchanger as claimed in claim 1, wherein said first separator wall member first section is curved generally along the periphery of said second opening.

4. A plate type heat exchanger as claimed in claim 1, wherein said second separator wall member first section is curved generally along the periphery of said third opening.

5. A plate type heat exchanger as claimed in claim 1, wherein said separator wall member is separate from said side wall member.

6. A plate type heat exchanger as claimed in claim 5, wherein tip end of said separator wall member second section is separate from tip end of said side wall member third section.

7. A plate type heat exchanger as claimed in claim 1, wherein said separator wall member integral with said side wall member.

8. A plate type heat exchanger as claimed in claim 7, wherein said separator wall member second section is integrally connected with said side wall member third section.

9. A plate type heat exchanger as claimed in claim 8, wherein said corrugated plate has a first end edge spaced from and parallel with the first shorter side of said plate section, and a second end edge spaced from and parallel with the second shorter side of said plate section, in which said first side wall member second section extends to contact said corrugated plate first end edge, and said second side wall member second section extends to contact said corrugated plate second end edge.

10. A plate type heat exchanger as claimed in claim 1, wherein said heat transmission plate vertical wall sections are integrally formed at their tip end with flanges which extend along the longer side of said plate section.

11. A plate type heat exchanger as in claim 1, wherein each of said side wall member and said separator wall member has a first face contactable through brazing metal with the first plate section of said first heat transmission plate, and a second face contactable through brazing metal with the second plate section of said second heat transmission plate, said first and second faces extending throughout the whole length of said side wall member and said separator wall member respectively.

12. A plate type heat exchanger as in claim 1, wherein each of said first, second, third and fourth vertical wall sections has inner and outer surfaces, the outer surface of said first vertical wall section being contactable through brazing metal with the inner surface of said third vertical wall section, the outer surface of said second vertical wall section being contactable through brazing metal with the inner surface of said fourth vertical wall section.

* * * * *